US007036346B2

(12) United States Patent
Burger

(10) Patent No.: US 7,036,346 B2
(45) Date of Patent: May 2, 2006

(54) APPARATUS FOR EXPOSING A PIPELINE TO HIGH INTERNAL PRESSURE

(75) Inventor: Manuel Burger, Nesselwang (DE)

(73) Assignee: Felss Burger GmbH, Nesselwang (DE)

( * ) Notice: Subject to any disclaimer, the term of this patent is extended or adjusted under 35 U.S.C. 154(b) by 45 days.

(21) Appl. No.: 10/302,089

(22) Filed: Nov. 22, 2002

(65) Prior Publication Data

US 2003/0115994 A1 Jun. 26, 2003

(30) Foreign Application Priority Data

Nov. 22, 2001 (DE) ..... 101 57 169

(51) Int. Cl.
*B21D 22/10* (2006.01)

(52) U.S. Cl. ..... 72/54; 72/56

(58) Field of Classification Search ..... 72/54, 72/56, 58, 61; 138/89, 90; 73/49.5, 49.6; 29/421.1; 417/392, 401, 403, 404
See application file for complete search history.

(56) References Cited

U.S. PATENT DOCUMENTS

| | | | | |
|---|---|---|---|---|
| 4,121,442 A | | 10/1978 | Brooks | |
| 4,237,723 A | * | 12/1980 | Kent | 73/49.6 |
| 4,417,459 A | * | 11/1983 | Tomita | 72/56 |
| 4,430,887 A | * | 2/1984 | Roberts et al. | 73/49.5 |
| 4,571,969 A | | 2/1986 | Tomita | |
| 4,887,646 A | * | 12/1989 | Groves | 138/90 |
| 5,177,990 A | * | 1/1993 | Isgen | 72/54 |
| 5,419,184 A | * | 5/1995 | Pace | 73/49.6 |
| 6,086,338 A | * | 7/2000 | Higgins | 417/392 |
| 6,418,770 B1 | * | 7/2002 | Binno | 72/58 |
| 2003/0133810 A1 | * | 7/2003 | Leppin et al. | 417/254 |

FOREIGN PATENT DOCUMENTS

| | | |
|---|---|---|
| DE | 11 71 941 | 6/1964 |
| DE | 100 00 796 | 6/2001 |
| EP | 0414 545 | 2/1991 |
| EP | 0 512 160 | 11/1992 |

* cited by examiner

*Primary Examiner*—Ed Tolan
(74) *Attorney, Agent, or Firm*—Collard & Roe, P.C.

(57) ABSTRACT

An apparatus for exposing a pipeline to a high internal pressure of the order of 1000 to 15000 bar, having at least a first, substantially stationary receiving device for a first end of the pipeline and a second receiving device for a second end of the pipeline, wherein the second receiving device is arranged so as to be spatially freely adjustable.

10 Claims, 3 Drawing Sheets

APPARATUS FOR EXPOSING A PIPELINE TO HIGH INTERNAL PRESSURE

BACKGROUND

The invention relates to an apparatus that exposes a pipeline to a high internal pressure ranging from 1000 to 15000 bar. The apparatus has a substantially stationary first receiving device for a first end of the pipeline and a second receiving device for a second end of the pipeline.

The exposure of pipelines to high internal pressure, a process known as autofrettage, effects material conversion, enabling the treated pipelines to withstand high internal pressures for long periods of time.

SUMMARY

The object of this invention is to provide an apparatus that can efficiently apply the autofrettage process. The apparatus has a substantially stationary first receiving device for a first end of the pipeline and a second receiving device for a second end of the pipeline. The invention can apply this autofrettage process more efficiently with a second receiving device that is freely movable in space. Thus, the apparatus can be simply adapted to all desired pipeline sizes and geometries without having to make substantial alterations.

The second receiving device is preferably mounted on a change-over device. Thus, when changes in pipeline size or geometry are too large to be covered by the adjustability of the receiving device, it may simply be replaced. It is also possible to arrange the stationary receiving device on a change-over device, or a plurality of receiving devices on the change-over device.

The first stationary receiving device has a pincer gripper, which may directly or indirectly grip the pipeline and press it against a pressure supply means. This provides a simple and efficient method of pressing the pipeline against the pressure supply.

The pincer gripper is mounted so that it swivels and is adjustable in the lengthwise direction, making it particularly easy for the gripper to grasp the pipeline.

In addition, the pincer gripper has a curved shoulder. This shoulder is acted upon by a displaceably mounted cam which swivels the gripper when it is displaced. The cam enables positioning of the gripper on the pipeline and presses it against the pressure supply.

The swivel bearing of the gripper is mounted on a displaceable intermediate component. The intermediate component has a projection on which the cam acts at the end of the swivel movement of the gripper. The cam is arranged on the connecting rod of a hydraulic cylinder. Thus, the gripper may be swivelled and moved linearly with a single linear movement of the hydraulic cylinder.

Compression springs act on the gripper or the intermediate component. A spring acting contrary to the swivel movement may also be arranged on the gripper.

One of the two receiving devices has a hydraulic pump which converts a supply pressure of approximately 100 to 200 bar into an output pressure of 1000 to 15000 bar. This hydraulic pump provides the hydraulic pressure required for performing autofrettage.

The hydraulic pump comprises a double piston/cylinder arrangement, wherein the pistons are rigidly connected and the piston facing the supply side comprises a larger active surface than the output side piston. This provides simple generation of the desired high pressure.

The ratio of cross-sectional areas of the two piston/cylinder arrangements is approximately 1:10 to 1:150, preferably 1:70. This ratio provides the desired pressure increase.

There is an opening in the cylinder walls of the piston/cylinder arrangement with the smaller cross section. The opening is open when the piston is retracted and closed when the piston is advanced. Hydraulic oil is fed in through this opening. The oil flushes and fills the pipeline so that it may be exposed to high pressure. When the smaller piston is advanced and the opening is closed, the pressure may build up. After the opening has been exposed to pressure, it is released once again so that the hydraulic oil may be removed again from the pipeline. If necessary, air flushing is possible via this opening, to provide for complete removal of the hydraulic oil from the pipeline.

A hydraulic line is attached to the cylinder with the larger cross section, on each side of the piston. This allows the piston to be exposed to supply pressure and restore it to its original position.

Both receiving devices have a substantially needle-shaped nozzle, which engages an open end of the pipeline. The pipeline is simply centered on the receiving device and the ready-shaped pipeline is not subsequently influenced at its connection points.

The ends of the pipeline may have an enlarged portion that are pressed against the needle-shaped nozzle. The gripper may act directly on this enlarged portion or via a union nut.

The second receiving device has an adjustable piston and bears an adjustable receptacle at its open end for the second end of the pipeline. When the pipeline is inserted into the apparatus, the first end of the pipeline may thus be inserted into the first receiving device and at the same time the second end brought up to the second receiving device. Thus, a suitable connection is easily created via the adjustability of the receptacle.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1:
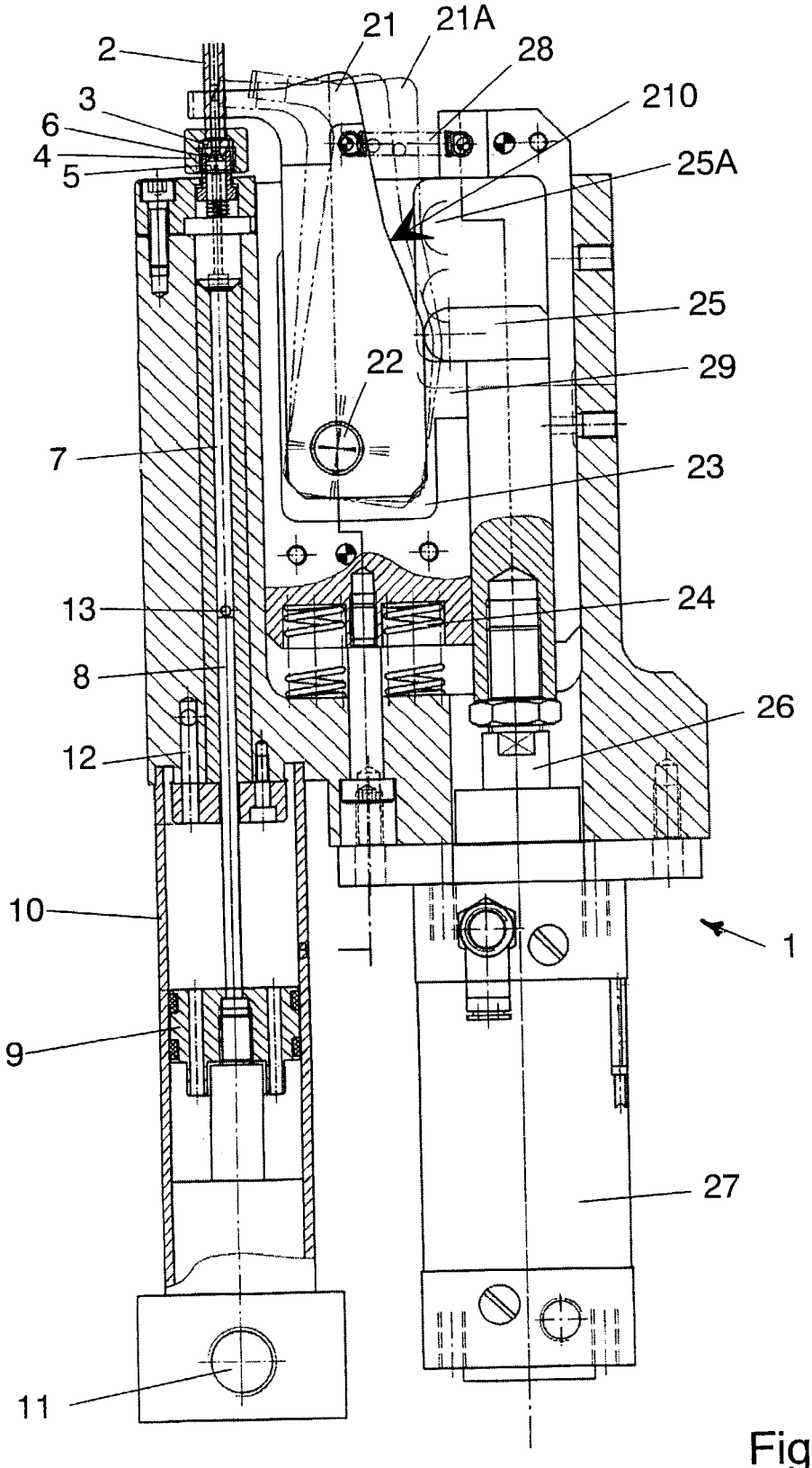
FIG. 1 shows a first receiving device of an apparatus for exposing a pipeline to high internal pressure.

Referring in detail to the drawings, FIG. 1 has a first receiving device 1 connected to a first end of a pipeline 2. The two ends of pipeline 2 each have an enlarged portion 3, behind which there is arranged a union nut 4. Receiving device 1 has a receptacle 5 with a nozzle needle 6, which extends into the end of pipeline 2 when it is positioned thereon. A high pressure cylinder 7, having a high pressure piston 8, is connected to nozzle 6. High pressure piston 8 is connected rigidly with a second piston 9, which is located in a further cylinder 10. At the lower end of cylinder 10, there is a connection 11 for a hydraulic feed line (not shown in detail) while a further hydraulic connection 12 is located at the upper end.

In FIG. 1, the two pistons are in their lower starting positions, in which an opening 13, in the wall of cylinder 7 is accessible. Flushing oil is introduced into cylinder 7 and pipeline 2 through opening 13. When the piston travels upwards, piston 8 closes this opening.

To press pipeline 2 against receptacle 5, there is a pincer gripper 21 having a notch in which pipeline 2 may engage upon the positioning of the gripper. Gripper 21 is mounted on a support 23 so as to be swivellable about an axis of rotation 22. Support 23 is mounted so that it is displaceable in the lengthwise direction. A plurality of compression springs 24 act on this support and press the support and pincer gripper 21 into their upper starting position. Gripper 21 then assumes the position designated 21A. Gripper 21 has a curved shoulder 210, on which a displaceable cam 25 acts. Displaceable cam 25 is displaceable in the lengthwise direction. Cam 25 is attached to a piston rod 26 of a hydraulic cylinder 27. In its starting position 25A, cam 25 adjoins shoulder 210 of gripper 21A, which is held in this starting position by a restoring spring 28. When cam 25 travels downwards into the position designated 25, gripper 21 is forced into its other end position, wherein it surrounds pipeline 2. Cam 25 then lies against a projection 29 provided on support 23. When cam 25 travels further, gripper 21 is thus likewise lowered, positions itself against union nut 4 and presses the pipeline against receptacle 5.

Figure 2:
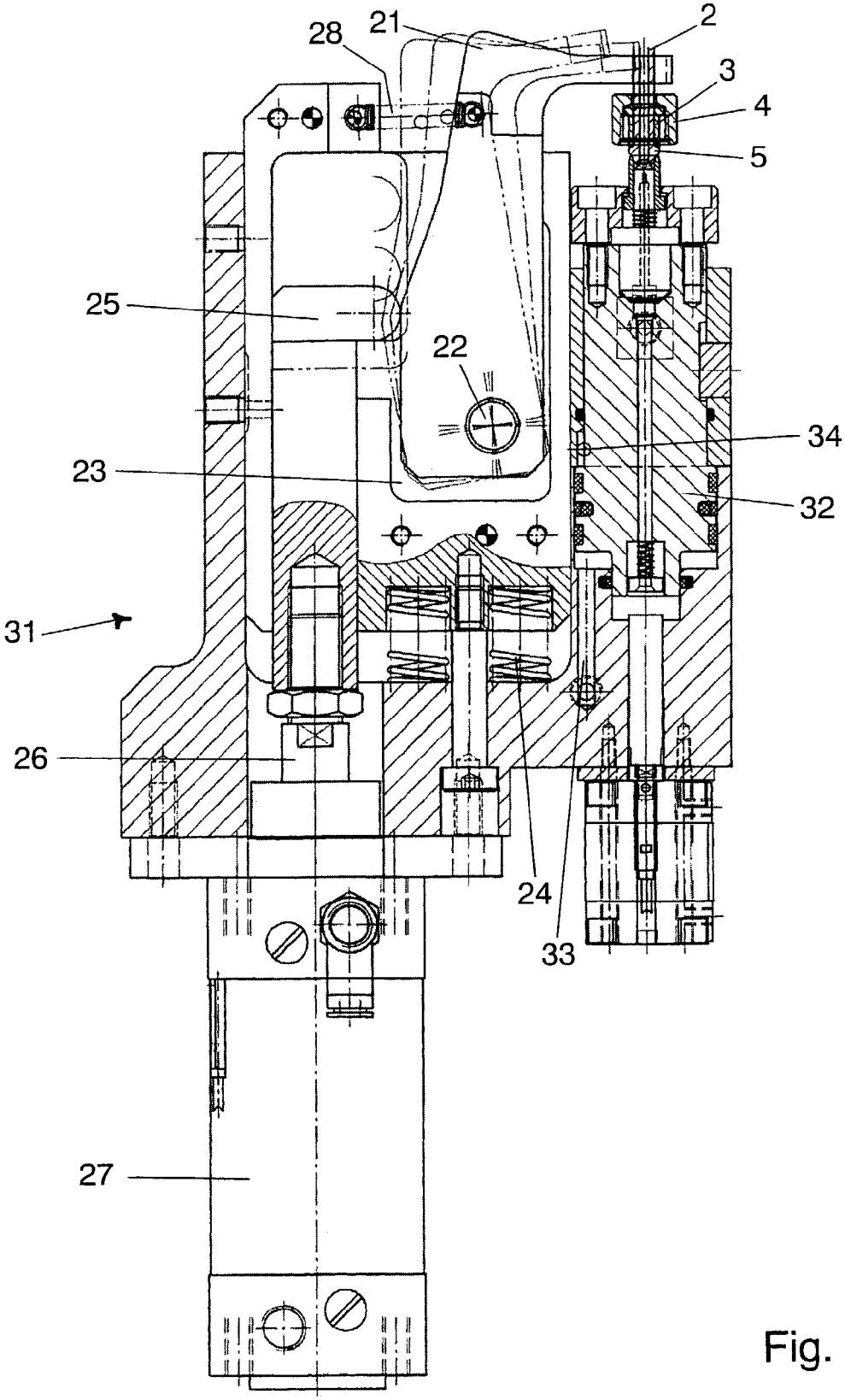
FIG. 2 shows a second receiving device for the other end of the pipeline.

FIG. 2 shows the other end of pipeline 2 accommodated by a second receiving device 31, which, as far as gripper 21 and cam 25 are concerned, is constructed like the receiving device 1 of FIG. 1. In contrast, receptacle 5 is located on a height-adjustable piston 32, which may be adjusted via two pneumatic connections 33 and 34, whereby receptacle 5 may be moved towards the end of the pipeline.

Figure 3:
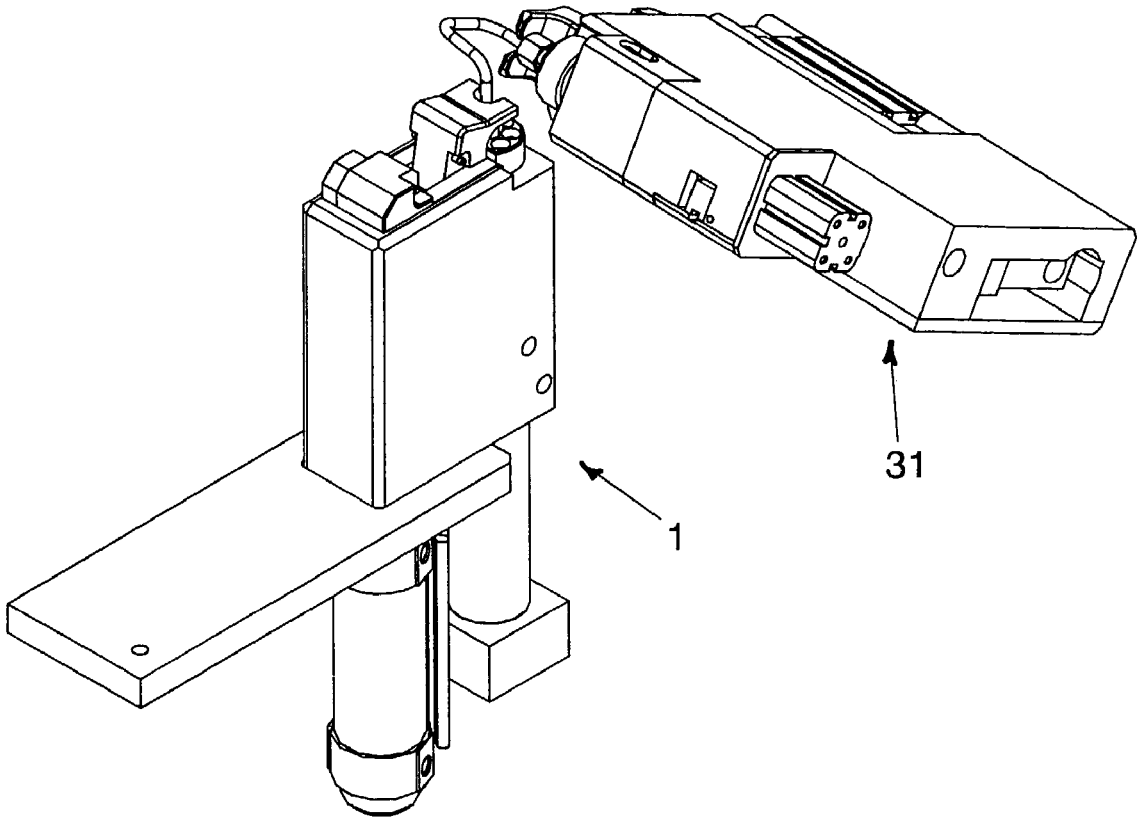
FIG. 3 is a three-dimensional representation of the two receiving devices.

FIG. 3 shows a three-dimensional arrangement of two receiving devices 1 and 31, wherein the position of the two receiving devices relative to one another is dependent on the length and shape of the pipeline. Second receiving device 31 is freely movable spatially and both are appropriately arranged on a change-over device so that they may be quickly replaced. The arrangement of a plurality of receiving devices on a common change-over device has proven particularly advantageous.

To perform the autofrettage process, the one end of a pipeline which has been cut to length and having end pieces and bent into shape, is inserted into receiving device 1 and clamped by means of gripper 21. The other end of the pipeline is then located directly over receptacle 5 of second receiving device 31, which has been moved into the appropriate position. Receptacle 5 of second receiving device 31 is then moved towards the pipe end and gripper 21 grasps the pipe and, via union nut 4, forces the pipe end against the receptacle.

Hydraulic fluid is then introduced via opening 13 into pipeline 2 and the latter is flushed. After a complete filling and venting of the pipeline, a hydraulic pressure of approximately 100 bar is applied to piston 9 via connection 11. The piston connected rigidly therewith is also moved upwards, closing opening 13 and ultimately generates a pressure in the pipeline of approximately 7000 to 8000 bar.

After completion of the autofrettage, connection 11 is opened and a counter-pressure is applied to piston 9 via connection 12, whereby piston 9 and piston 8 travel back. Pipeline 2 may then be emptied via opening 13. Thereafter, cam 25 travels upwards in both receiving devices 1 and 31, whereby pincer gripper 21 releases pipeline 2, which may then be removed.

Accordingly, while one embodiment of the present invention has been shown and described, it is to be understood that many changes and modifications may be made thereunto without departing from the spirit and scope of the invention as defined in the appended claims.

What is claimed is:

1. An apparatus that exposes pipeline to a high internal pressure ranging from 1000 to 15000 bar, comprising:

a substantially stationary first receiving device coupled to a first end of the pipeline;

a second receiving device coupled to a second end of the pipeline, wherein said second receiving device is arranged so as to be freely movable spatially; and a change-over device upon which said first receiving device and said second receiving device are mounted.

2. An apparatus that exposes a pipeline to a high internal pressure ranging from 1000 to 15000 bar, comprising:

a substantially stationary first receiving device coupled to a first end of the pipeline;

a second receiving device coupled to a second end of the pipeline;

a pincer gripper disposed in said first receiving device, wherein said pincer gripper directly or indirectly acts on the pipeline and presses it against a pressure supply means;

a displaceable intermediate component upon which a swivel bearing of said pincer gripper is mounted;

a displaceably mounted cam;

a projection provided with said displaceable intermediate component and on which said displaceably mounted cam acts at the end of the swivel movement of said pincer gripper;

a plurality of compression springs that act on said pincer gripper or said displaceable intermediate component.

3. The apparatus according to claim 2, wherein said pincer gripper is mounted so that it swivels and is adjustable in a lengthwise direction.

4. The apparatus according to claim 2, further comprising:

a curved shoulder disposed on said pincer gripper; and wherein said displaceably mounted cam acts on said curved shoulder and swivels said pincer gripper when displaced.

5. The apparatus according to claim 4, further comprising a hydraulic cylinder having a connecting rod on which said displaceably mounted cam is disposed.

6. The apparatus according to claim 2, further comprising a spring disposed on said pincer gripper, wherein said spring acts contrary to the swivel movement.

7. An apparatus that exposes a pipeline to a high internal pressure ranging from 1000 to 15000 bar, comprising:

a substantially stationary first receiving device coupled to a first end of the pipeline;

a second receiving device coupled to a second end of the pipeline; and at lease one hydraulic pump coupled to said first receiving device or said second receiving device, wherein said hydraulic pump converts a supply pressure of approximately 100 to 200 bar into an output pressure of 1000 to 15000 bar and wherein said pump has a double piston/cylinder arrangement, comprising a first and a second piston/cylinder with an opening disposed in a cylinder wall of said second piston/cylinder, said opening being open when said second piston is retracted and closed when said second piston is advanced.

8. The apparatus according to claim 7, wherein said pistons of said double piston/cylinder arrangement are connected rigidly together and a piston facing a supply side has a larger cross section than a second piston on an output side.

9. The apparatus according to claim 8, wherein the ratio of cross sectional areas of the two piston/cylinder arrangements is between 1:10 and 1:150.

10. The apparatus according to claim 8, further comprising a hydraulic line coupled to a cylinder with the larger cross section on each side of said first piston.

* * * * *